US007687728B2

(12) United States Patent
Poyner et al.

(10) Patent No.: US 7,687,728 B2
(45) Date of Patent: Mar. 30, 2010

(54) SAFETY SWITCH

(75) Inventors: Julian Poyner, Stockport Cheshire (GB); Burt Sacherski, Nashua, NH (US); David Williams, Crickhowell (GB)

(73) Assignee: Rockwell Automation Limited, Milton Keynes (GB)

( * ) Notice: Subject to any disclaimer, the term of this patent is extended or adjusted under 35 U.S.C. 154(b) by 812 days.

(21) Appl. No.: 11/489,821

(22) Filed: Jul. 20, 2006

(65) Prior Publication Data

US 2007/0068781 A1 Mar. 29, 2007

(30) Foreign Application Priority Data

Jul. 20, 2005 (GB) ..... 0514868.9
Jul. 12, 2006 (EP) ..... 06253656

(51) Int. Cl.
*H01R 33/955* (2006.01)

(52) U.S. Cl. ..... 200/52 R; 200/543; 200/573; 200/17 R

(58) Field of Classification Search ..... 200/52 R, 200/17 R, 537–546, 573, 574
See application file for complete search history.

(56) References Cited

U.S. PATENT DOCUMENTS

| | | | | |
|---|---|---|---|---|
| 3,870,846 | A | 3/1975 | Filip | |
| 4,458,122 | A * | 7/1984 | Knight | 200/518 |
| 5,002,098 | A * | 3/1991 | Desmet et al. | 139/194 |
| 5,041,705 | A * | 8/1991 | Piccoli | 200/52 R |
| 5,665,947 | A | 9/1997 | Falcon | |
| 6,365,850 | B1 * | 4/2002 | Arnold et al. | 200/17 R |

FOREIGN PATENT DOCUMENTS

| | | |
|---|---|---|
| GB | 2216721 A | 10/1989 |
| GB | 2216723 A | 6/1992 |

* cited by examiner

*Primary Examiner*—Kyung Lee
(74) *Attorney, Agent, or Firm*—Boyle Fredrickson LLP; William R. Walbrun

(57) ABSTRACT

A safety switch includes a cable having a first end connected to a cable translator moveable between a disengaged position and an engaged position, the cable having a second end for connection to a remote lock and power supply switch.

17 Claims, 5 Drawing Sheets

SAFETY SWITCH

CROSS REFERENCE TO RELATED APPLICATION

This application claims priority under 35 U.S.C. §119 to United Kingdom Patent Application No.0514868.9 filed Jul. 20, 2005, and EP Application No. 06253656.0, filed Jul. 12, 2006, the entirety of which are incorporated by reference herein.

FIELD OF THE INVENTION

The present invention relates to a safety switch which, for example, may be used with an electrical enclosure to prevent a user from becoming trapped inside the enclosure.

BACKGROUND OF THE INVENTION

It is well known to provide a housing around dangerous electromechanical machinery, and to provide a lock on the housing to prevent unauthorized access of users to the electromechanical machinery. Often a power supply switch is integrated with the lock, so that whenever the lock is opened to allow access to the electromechanical machinery, the supply of power to the machinery is automatically interrupted thereby turning off the machinery.

Typically, the lock is provided on the exterior of the housing of the electromechanical machinery. This means that if a user of the machinery were to be accidentally locked inside of the housing, the user may become trapped, and furthermore may be in close proximity to the electromechanical machinery when it is operating.

BRIEF DESCRIPTION OF THE INVENTION

It is an object of the present invention to substantially overcome or mitigate the above disadvantage.

According to the invention there is provided a safety switch for connection to a remote lock and/or a power supply switch, the safety switch comprising a cable having a first end connected to a cable translator moveable between a disengaged position and an engaged position, the cable having a second end for connection to the remote lock and/or power supply switch.

The invention is advantageous because the safety switch may be provided at any convenient location remote from the lock and/or power supply switch. For example, the safety switch may be provided within the housing of the electromechanical machinery, thereby allowing a user trapped within the housing to turn off the electromechanical machinery and to exit from the housing.

Preferably, the safety switch further comprises an actuator moveable between an unactivated position and an activated position, wherein the actuator is arranged such that when it is in the unactivated position it prevents the cable translator from being moved from the disengaged position, and when the actuator is moved to the activated position it allows the cable translator to move to the engaged position.

Preferably, the actuator is provided with a retaining mechanism arranged to prevent the actuator being ejected from the housing in the event that the cable is broken.

Preferably, one end of the cable translator abuts against the actuator when the actuator is in the unactivated position, and the actuator has an opening which allows at least part of the cable translator to pass through the actuator when the actuator is in the activated position.

Preferably, following movement of the cable translator to the engaged position, the actuator is fixed in the activated position until the cable translator is returned to the disengaged position.

Preferably, the cable translator is resiliently biased towards the engaged position.

Preferably, once at least part of the cable translator has passed through the actuator, the actuator cannot be returned to the unactivated position without first withdrawing the cable translator from the opening.

Preferably, the actuator is resiliently biased to the unactivated position.

Preferably, the cable translator is provided with a handle which allows the cable translator to be easily returned to the disengaged position.

Preferably, the handle is removable from cable translator, and the cable translator may be returned to the disengaged position by first engaging the handle with the cable translator.

Preferably, the cable is at least in part surrounded by a sheath which is fixed such that the cable moves within the sheath when the cable translator moves.

Preferably, the second end of the cable protrudes from the sheath to allow the cable to be connected to the lock and/or the power supply switch.

Preferably, the safety switch further comprises a housing having a bracket to allow the safety switch to be mounted on a wall or other suitable surface.

The safety switch may have a circular cross section. Alternatively, the safety switch may have a non-circular cross section.

BRIEF DESCRIPTION OF THE DRAWINGS

A specific embodiment of the invention will now be described by way of example only with reference to the accompanying drawings, in which.

DETAILED DESCRIPTION OF THE PREFERRED EMBODIMENT

Figure 1:
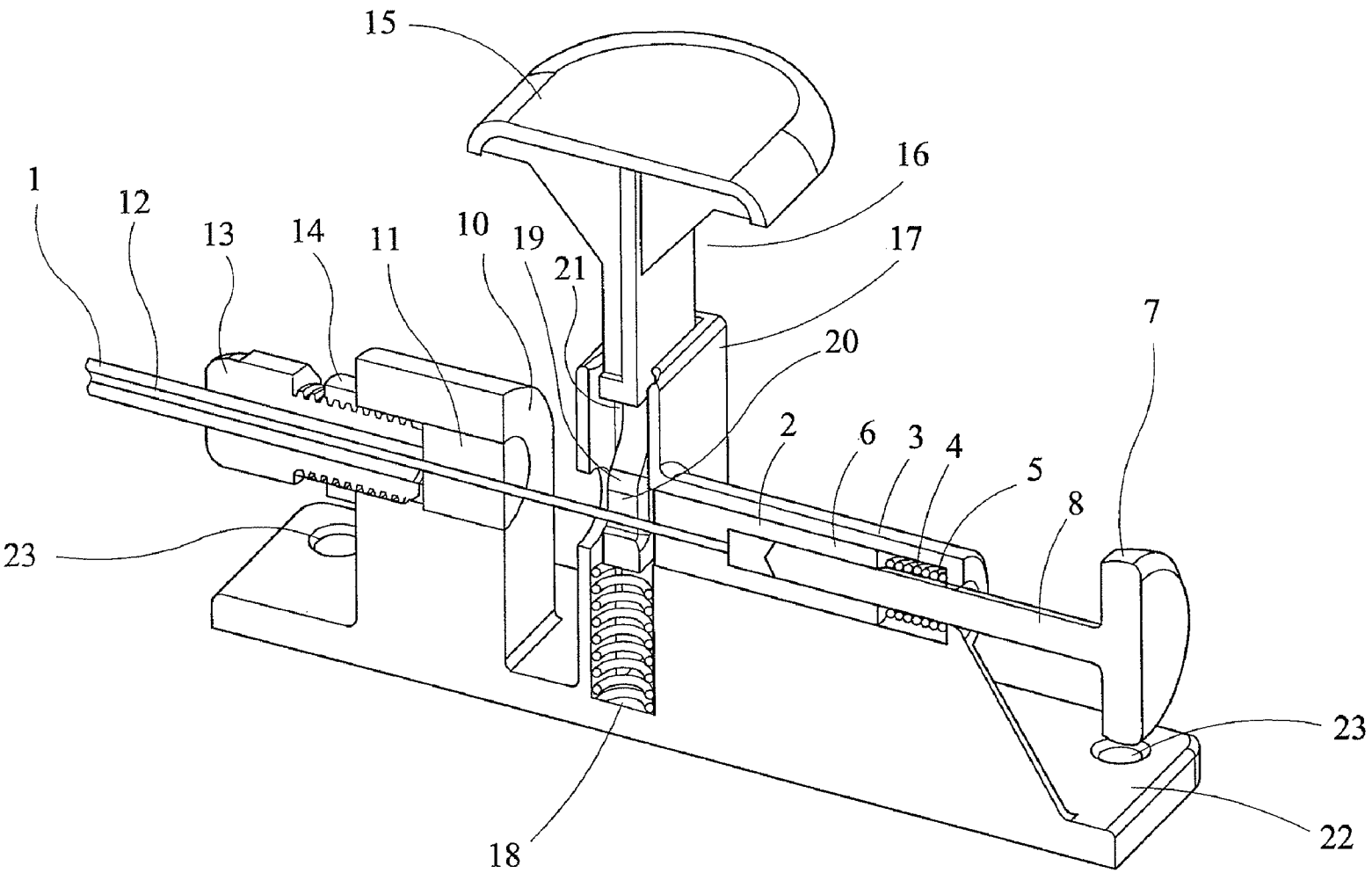
FIG. 1 is a cross sectional view of the a switch which embodies the invention, with an actuator in an unactivated position.

A safety switch which embodies the invention is shown in cross-section in FIG. 1. The safety switch comprises a cable 1 connected to one end of a piston 2 which is held in a cylindrical housing 3. A helical spring 4 is provided within the cylindrical housing 3 at an opposite end of the piston 2 from the cable 1. The helical spring pushes against an end surface 5 of the cylindrical housing 3, thereby resiliently biasing the piston 2 in the direction of the cable 1.

The piston 2 has a threaded bore 6 which receives a correspondingly threaded end of a handle 7, thereby securing the handle 7 to the piston 2. The helical spring 4 passes around a shaft 8 of the handle 7.

The cable 1 passes through a cable housing 10, which is spaced apart from the cylindrical housing 3. A cylinder 11 with a narrow bore is held within the cable housing 10. The cable 1 passes through the cylinder 11, the narrow bore of the cylinder acting to prevent dust, liquid etc contaminating the cable within the cable housing 10.

The portion of the cable 1 which passes from the piston 2 to the cylinder 11 is exposed. The remainder of the cable 1 shown in FIG. 1 is surrounded by a sheath 12. The sheath 12 may for example comprise a hollow cable formed from spiral steel wire with a plastic outer coating. The cable 1 may slide up and down within the sheath 12; this arrangement is commonly referred to as a Bowden cable. A second end 24 of cable 1 is connectable to a remote lock and/or power supply switch 25.

A cable tensioner 13 extends from one side of the cable housing 10, and grips the sheath 12. The tensioner 13 is threaded, and is received in a correspondingly threaded opening in the cable housing 10. The tensioner may be screwed further into the cable housing 10, or screwed in an opposite direction so that it extends further out of the cable housing 10. Since the tensioner 13 grips the sheath 12, whereas the cable 1 is free to slide within the sheath 12, adjusting the tensioner has the effect of drawing the sheath 12 over the cable (thereby changing the amount of cable 1 which extends beyond either end of the sheath 12). The tensioner 13 is provided with a nut 14 which is used to secure the tensioner in a desired position.

The safety switch is provided with an actuator, which comprises a button 15 on a shaft 16 that extends perpendicularly to the cable 1. The shaft 16 of the button 15 is held within a rectangular housing 17. A helical spring 18 is provided in the rectangular housing 17, and pushes against a foot of the shaft 16, thereby resiliently biasing the shaft 16 out of the rectangular housing.

The shaft 16 is provided with a slot 19 (since FIG. 1 is in cross-section only half of the slot is shown). The slot 19 is in two parts, a lower part 20 of the slot is narrow, being sufficiently wide to allow the cable 1 to pass through it. An upper part 21 of the slot 19 is considerably wider, and is circular in shape.

The button 15 is prevented from being pushed out of the rectangular housing 17 under the force of the helical spring 18, by the cable 1 which passes through the slot 19 (a bottom end of the slot pushes against the cable).

The cylindrical housing 3, cable housing 10 and rectangular housing 17 are all mounted on a bracket 22. The bracket 22 is provided with openings 23 which are dimensioned to receive screws or other fasteners, which may be used to fix the safety switch to a wall or some other suitable location.

An opposite end of the cable 1 and the sheath 12 is connected to a lock (not shown) which is provided at a door of a housing of dangerous electromechanical machinery. The lock is arranged to ensure that access is not allowed to the electromechanical machinery unless the lock is open. In some instances, the lock may be directly connected to an electrical power supply for the electromechanical machinery, with the effect that as soon as the lock is opened the power supply is interrupted and the electromechanical machinery stops operating. During normal use, the lock is electrically operated, and is moved between an open and a closed configuration by actuating an electrical switch.

The safety switch described in relation to FIG. 1 may be located within the housing of the electromechanical machinery. In use, during normal operation, the piston 2 and the button 15 of the safety switch are in the configuration shown in FIG. 1. The cable 1 pushes against a lever of the lock at the door of the housing of the electromechanical machinery, thereby retaining the lock in a closed configuration, preventing access to the electromechanical machinery (and in some cases allowing power to be supplied to the electromechanical machinery).

It is possible that a user of the electromechanical machinery may become trapped within the housing. For example, since the lock is electrically operated it will not be possible to operate the lock in the event of a power outage, and this may mean that a user is trapped within the housing.

Figure 2:
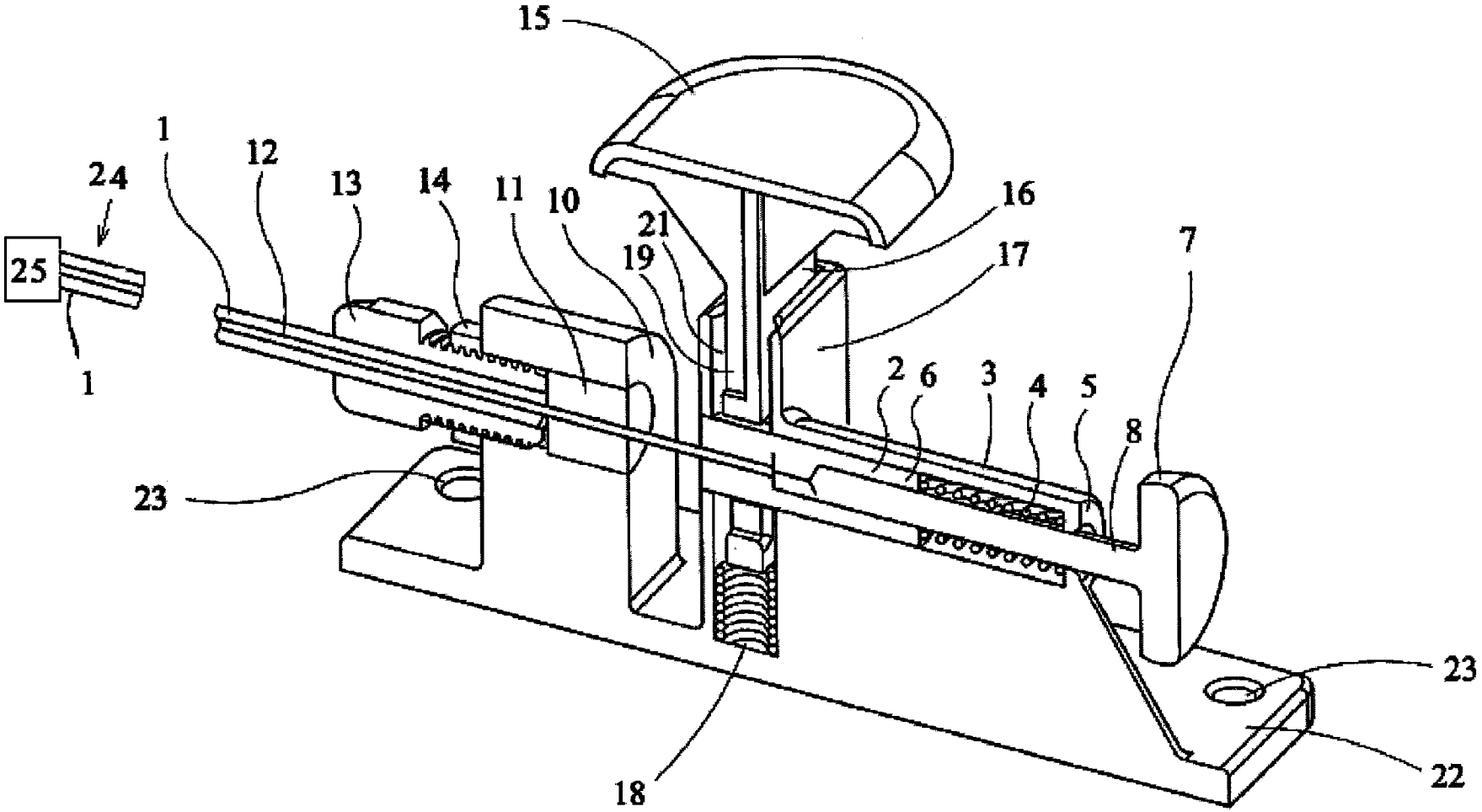
FIG. 2 is a cross sectional view of the safety switch of FIG. 1 with the actuator in an activated position.

The safety switch of FIG. 1 is provided at a convenient location, for example around chest height close to the door of the electromechanical machinery. The user presses the button 15, pushing the button and the shaft 16 downwards against the helical spring 18. Once the button 15 has been pushed down through a required distance, the circular upper part 21 of the slot 19 becomes aligned with the piston 2. At this point the piston 2 passes through the circular upper part 21 of the slot 19, under the biasing force of the helical spring 4. This is shown in FIG. 2. The cable 1, which is attached to the piston 2, is pushed outwards, i.e. the cable 1 effectively lengthens. Since the sheath 12 provided around the cable 1 has not lengthened, this has the effect that an equivalent length of cable is pushed out of the sheath at an opposite end of the sheath. This movement of the cable actuates the lever at the lock, thereby opening the lock.

It will be appreciated that, once the button 15 has been pushed downwards, and the piston 2 has passed into the circular upper part 21 of the slot 19, the button 15 is then secured in the configuration shown in FIG. 2. In order for the button 15 to return to its raised position, the piston 2 must be withdrawn from the circular upper part 21 of the slot 19 by pulling on the handle 7. When this is done, the button 15 rises automatically, under the bias from the helical spring 18, and returns to the configuration shown in FIG. 1.

The action of withdrawing the piston 2 from the circular upper part 21 of the slot 19 draws the cable 1 through the sheath 12, closing the lock. Since the safety switch is located within the housing of the electromechanical machinery, one or more additional switches may be used to ensure that the door of the housing remains unlocked when the safety switch is reset (otherwise the user would upon resetting the safety switch be locked in the housing together with operating electromechanical machinery). The one or more additional switches should be conveniently located outside of the housing, to allow them to be turned on after the user has left the housing and closed the housing door.

In some cases it may be preferred to not allow the safety switch to be returned to the configuration shown in FIG. 1 without using a key (for example if the safety switch must be reset by an engineer responsible for safety). Where this is the case, the handle 7 may be removed from the piston 2 by unscrewing it. Only the person in possession of the handle 7 can reset the safety switch, by screwing the handle into the piston 2 and then withdrawing the piston. The handle 7 thus acts as a key.

Figure 3:
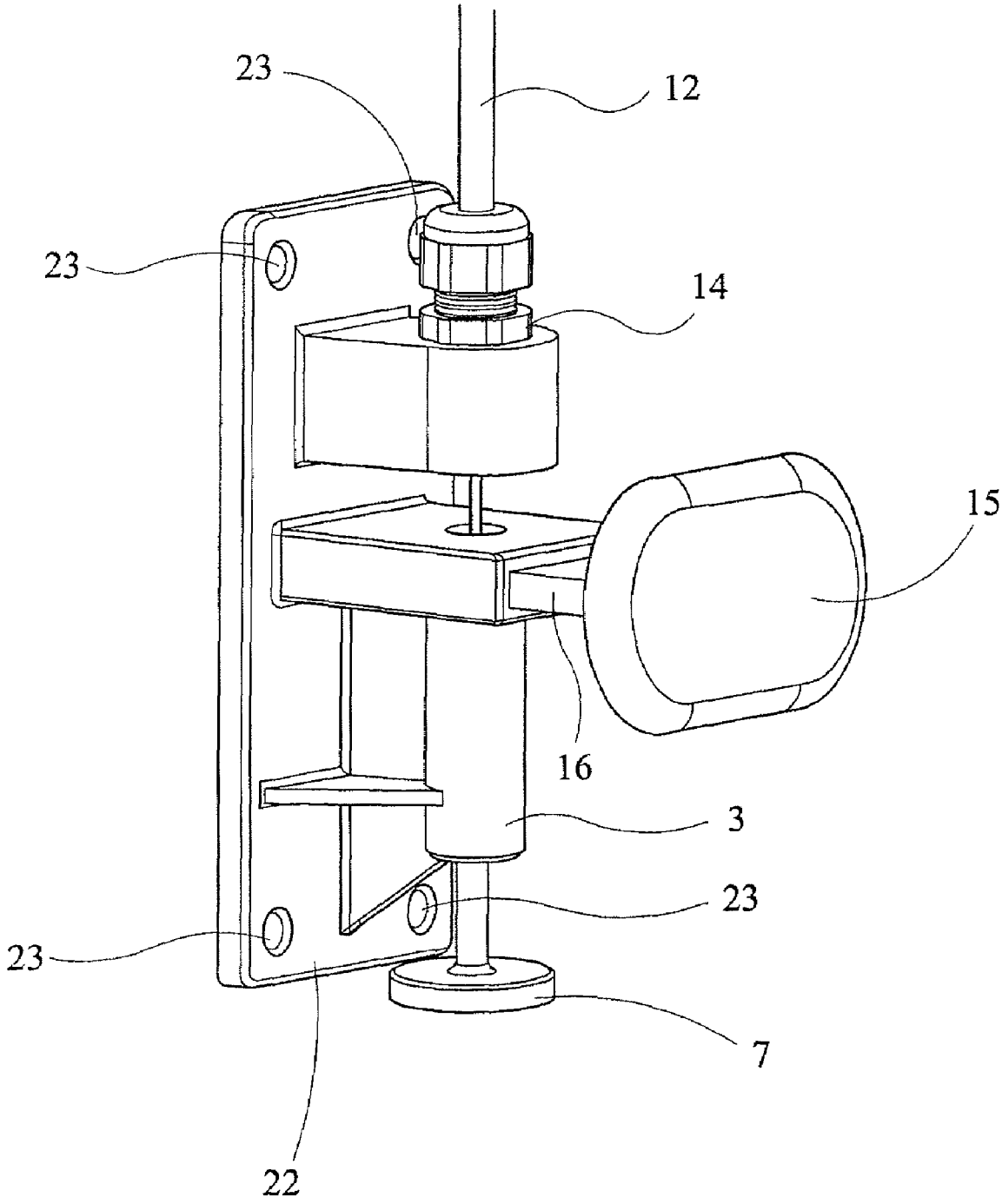
FIG. 3 is a perspective view of the safety switch of FIGS. 1 and 2.

In order to allow a full understanding of the appearance of the safety switch, a perspective view of the safety switch is shown in FIG. 3. The reference numerals shown correspond to those used in relation to FIGS. 1 and 2.

Figure 4:
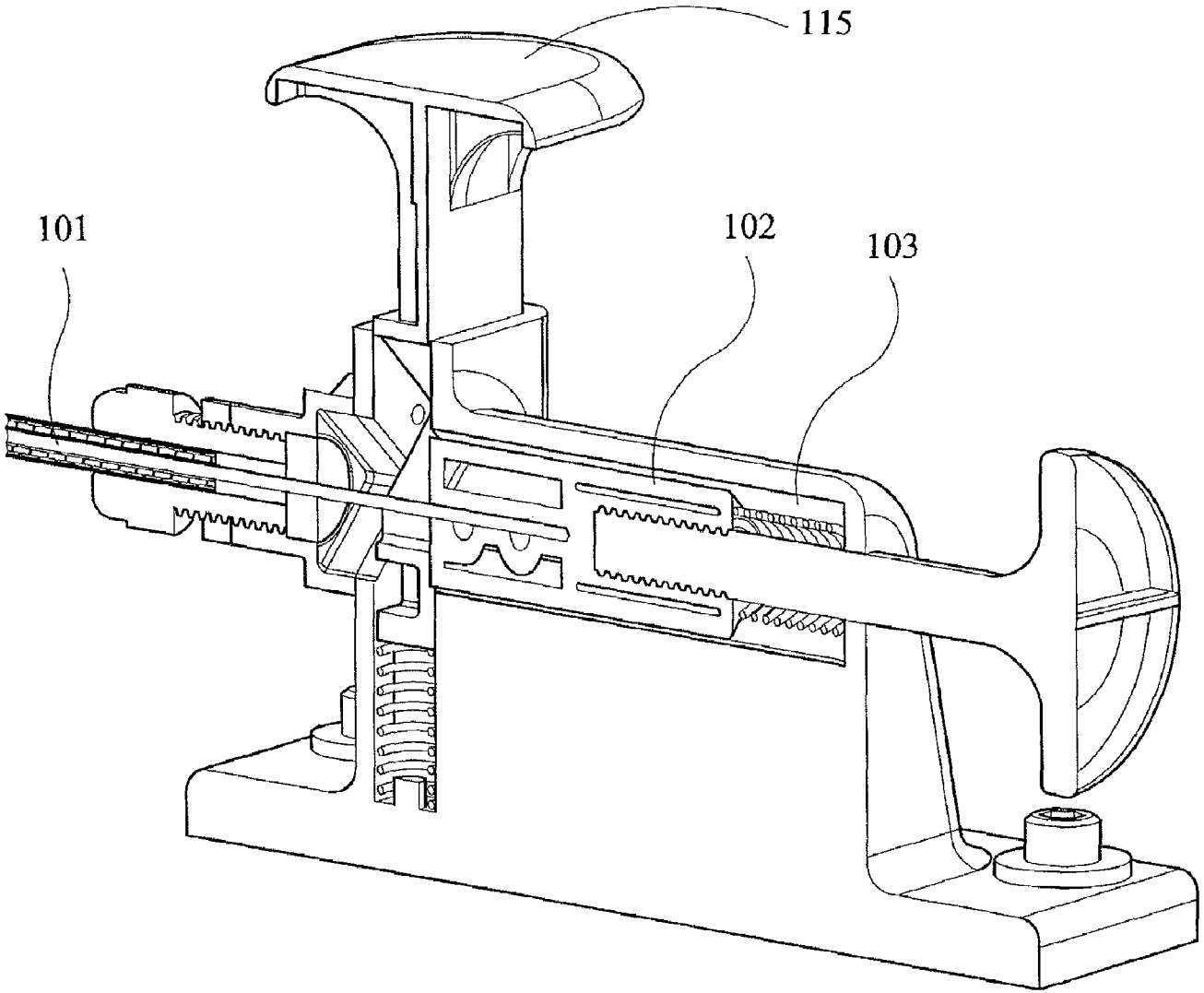
FIG. 4 is a perspective view of a modified safety switch which embodies the invention.

FIG. 4 is a perspective view of a modified version of the safety switch. Many parts of the safety switch shown in FIG. 4 correspond with the safety switch described above, and will not be described again here. Parts which have been modified include the piston 102 and the button 115. The piston 102 is provided with a square cross-section rather than the circular cross-section piston shown in FIGS. 1 and 2. A housing 103 which contains the piston 102 has a corresponding square shaped cross section. The square shaped cross section of the piston 102 and corresponding cross sectional shape of the housing 103 has the advantage that it prevents rotation of the piston within the housing. This in turn prevents the cable 101 from becoming twisted. Any non-circular cross sectional shape will provide this advantage.

Figure 5:
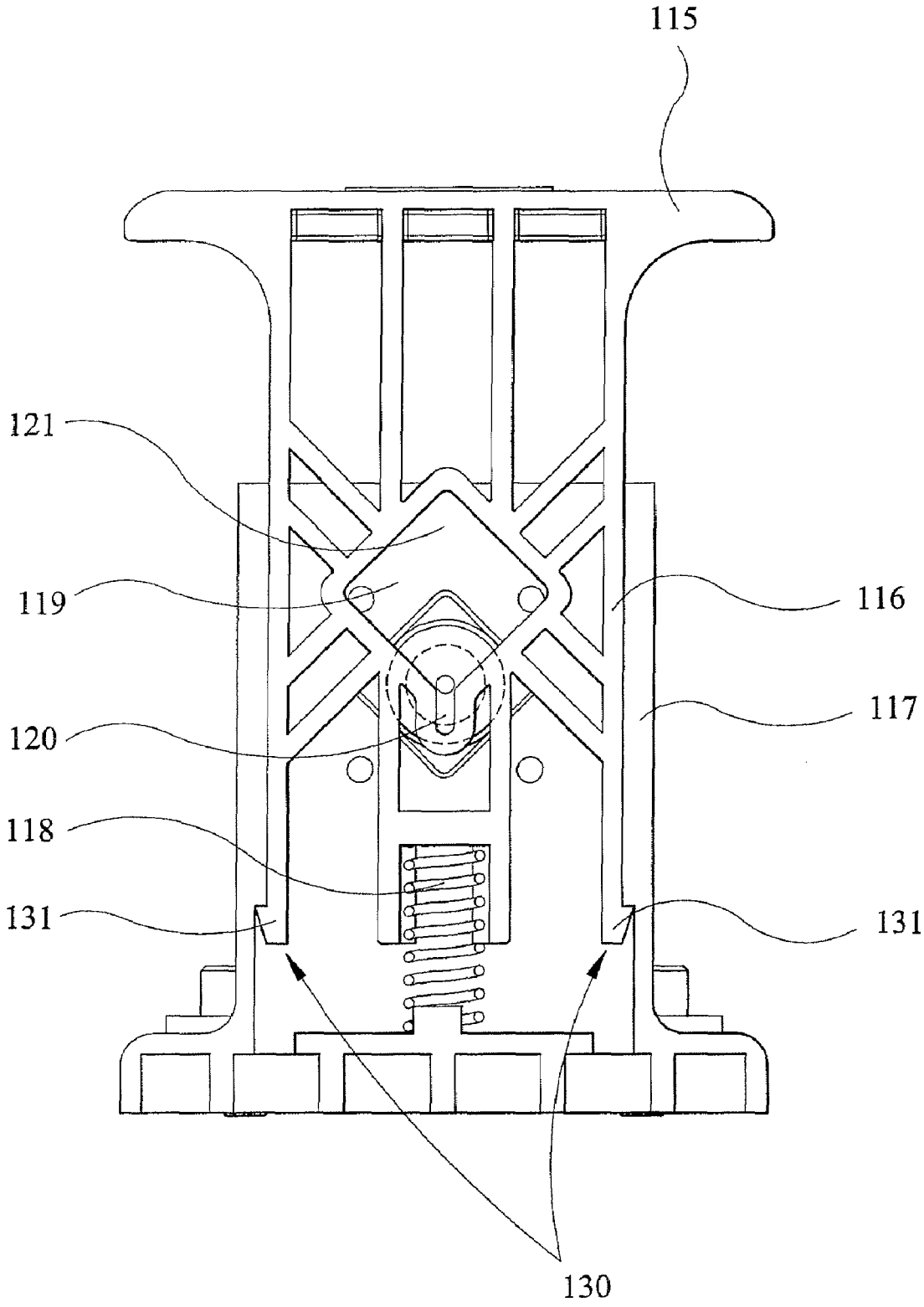
FIG. 5 is a cross-sectional view of part of the safety switch of FIG. 4.

FIG. 5 shows in cross section the button 115 of the safety switch and its rectangular housing 117. The button has a slot 119 for receiving the piston 102. A lower part 120 of the slot is narrow, being sufficiently wide to allow that cable 101 to pass through it. An upper part 121 of the slot 119 is considerably wider and has a square cross sectional shape. In use, the button 115 is pressed downwards, thereby aligning the piston 102 with the square cross sectioned opening 119, and allowing the piston to pass through it. The manner of operation of the safety switch is equivalent to that described further above in relation to FIGS. 1 to 3.

Protrusions 130 are provided at a lower end of a shaft 116 attached to the button 115, and are arranged to engage with lips 131 provided in the rectangular housing 117. This engagement prevents the button 115 and shaft 116 from being ejected from the housing by the helical spring 118 in the event that the cable 101 is broken. This is an example of a retaining mechanism which may be used to retain the button 115 in the housing 117. It will be appreciated by those skilled in the art that other retaining mechanisms may be used.

The safety switch may be fabricated from any suitable materials. For example, the cable 1 and the helical springs 4, 18 may be made from steel, with the remaining components being made from suitable plastic or rubber. The housings 3, 10, 17 may be integrally molded as a single entity with the bracket 22.

It will be appreciated that the piston 2 is one example of a cable translator, and that other forms of cable translator may be used (for example the cable translator may comprise a lever or some other arrangement). Although the illustrated piston 2 has a circular cross section, it may have any other suitable cross section.

Although the actuator is shown as a button 15 provided on a shaft 16, it will be appreciated that the actuator may have some other suitable form.

The safety switch may be located a considerable distance away from the lock, the maximum distance being dependent upon the length of the cable 1. The cable 1 may for example be 1 meter long, 3 meters long or more.

As described above, the safety switch may be provided inside the housing of electromechanical machinery. Alternatively, the safety switch may be outside of the housing, for example provided at a more convenient location than the lock so that it can be easily located in the event of an emergency.

As was mentioned above, in some instances the lock provided on the door of the electromechanical machinery housing may also be directly connected to an electrical power supply for the electromechanical machinery. The lock may be arranged such that as soon as the lock is opened the power supply is interrupted and the electromechanical machinery stops operating. Where this is the case the safety switch may, in addition to opening the lock, also interrupt the power supply to the electromechanical machinery. This may be useful for example if a user is trapped within the housing when the electromechanical machinery begins to operate. This may happen if a second user has mistakenly closed the door of the housing of the machinery, and closed the lock. It is also possible that the lock does not lock the door of the electromechanical machinery, but instead is arranged only to interrupt the power supply to the electromechanical machinery.

The safety switch may be connected for example to combined locks and power supply switches (sometimes referred to as interlock switches with guard locking) sold by EJA Engineering Limited of Lancashire, UK. Examples of such switches include switches sold under the names TLS-GD2, Spartan and Atlas.

What we claim is:

1. A safety switch comprising:

a remote lock and power supply switch;

a cable having a first end connected to a cable translator moveable between a disengaged position and an engaged position, the cable having a second end for connection to the remote lock and power supply switch;

an actuator moveable between an unactivated position and an activated position, wherein the actuator is arranged such that when it is in the unactivated position it prevents the cable translator from being moved from the disengaged position, and when the actuator is moved to the activated position it allows the cable translator to move to the engaged position; and wherein one end of the cable translator abuts against the actuator when the actuator is in the unactivated position. and the actuator has an opening which allows at least part of the cable translator to pass through the actuator when the actuator is in the activated position.

2. A safety switch according to claim 1, wherein the safety switch is arranged such that following movement of the cable translator to the engaged position, the actuator is fixed in the activated position until the cable translator is returned to the disengaged position.

3. A safety switch according to claim 1, wherein the actuator is provided with a retaining mechanism arranged to prevent the actuator being ejected from a housing holding the actuator in the event that the cable is broken.

4. A safety switch according to claim 1, wherein the cable translator is resiliently biased towards the engaged position.

5. A safety switch according to claim 1, wherein the actuator has an opening which allows at least part of the cable translator to pass through the actuator when the actuator is in the activated position and wherein once at least part of the cable translator has passed through the actuator, the actuator cannot be returned to the unactivated position without first withdrawing the cable translator from the opening.

6. A safety switch according to claim 1, wherein the actuator is resiliently biased to the unactivated position.

7. A safety switch according to claim 1, wherein the cable translator is provided with a handle which allows the cable translator to be easily returned to the disengaged position.

8. A safety switch according to claim 7, wherein the handle is removable from cable translator, and the cable translator may be returned to the disengaged position by first engaging the handle with the cable translator.

9. A safety switch according to claim 1, wherein the cable is at least in part surrounded by sheath which is fixed such that the cable moves within the sheath when the cable translator moves.

10. A safety switch according to claim 9, wherein the second end of the cable protrudes from the sheath to allow the cable to be connected to the lock and/or the power supply switch.

11. A safety switch according to claim 1, wherein the safety switch further comprises a housing having a bracket to allow the safety switch to be mounted on a wall or other suitable surface.

12. A safety switch according to claim 1, wherein the lock and power supply switch is arranged to be electrically operated during normal use.

13. A safety switch according to claim 1, wherein the lock and/or the power supply switch is configured such that it may be locally operated without using the safety switch.

14. A safety switch according to claim 1, wherein the cable translator has a circular cross section.

15. A safety switch according to claim 1, wherein the cable translator has a non-circular cross section.

16. A release for use with a remote lock and/or power supply switch, the release comprising:

a bracket providing a mounting surface affixable to a surface;

a cable translator moveable between a disengaged position and an engaged position relative to the bracket and resiliently biased towards the engaged position;

a cable supported by the bracket and having a first end connected to the cable translator and a second end for connection the remote lock and/or power supply switch;

an actuator moveable between an unactivated position and an activated position, and resiliently biased to the unactivated position, wherein the actuator is arranged such that when it is in the unactivated position it prevents the cable translator from being moved from the disengaged position, and when the actuator is moved to the activated position it allows the cable translator to move to the engaged position;

wherein the cable translator engages the actuator such that movement of the actuator to the activated position causes the cable translator to move to the engaged position wherein the cable translator passes through the actuator, and so that following movement of the cable translator to the engaged position, the actuator is fixed in the activated position until the cable translator is returned to the disengaged position.

17. A safety switch comprising:

a remote lock and power supply switch;

a cable having a first end connected to a cable translator moveable between a disengaged position and an engaged position, the cable having a second end for connection to the remote lock and power supply switch;

an actuator moveable between an unactivated position and an activated position, wherein the actuator is arranged such that when it is in the unactivated position it prevents the cable translator from being moved from the disengaged position, and when the actuator is moved to the activated position it allows the cable translator to move to the engaged position; and wherein the actuator has an opening which allows at least part of the cable translator to pass through the actuator when the actuator is in the activated position and wherein once at least part of the cable translator has passed through the actuator, the actuator cannot be returned to the unactivated position without first withdrawing the cable translator from the opening.

* * * * *